US009719685B2

(12) United States Patent
Durbin et al.

(10) Patent No.: US 9,719,685 B2
(45) Date of Patent: Aug. 1, 2017

(54) SYSTEM AND METHOD FOR FLAME STABILIZATION

(75) Inventors: Mark David Durbin, Springboro, OH (US); Mark Anthony Mueller, West Chester, OH (US); Lance Kenneth Blakeman, Mason, OH (US); David Albin Lind, Lebanon, OH (US)

(73) Assignee: General Electric Company, Schenectady, NY (US)

( * ) Notice: Subject to any disclaimer, the term of this patent is extended or adjusted under 35 U.S.C. 154(b) by 1264 days.

(21) Appl. No.: 13/557,750

(22) Filed: Jul. 25, 2012

(65) Prior Publication Data

US 2013/0152597 A1 Jun. 20, 2013

Related U.S. Application Data

(60) Provisional application No. 61/577,934, filed on Dec. 20, 2011.

(51) Int. Cl.
*F23R 3/28* (2006.01)
*F23R 3/34* (2006.01)

(52) U.S. Cl.
CPC ..... *F23R 3/286* (2013.01); *F23R 3/346* (2013.01); *F23D 2900/00008* (2013.01); *F23D 2900/00015* (2013.01)

(58) Field of Classification Search
CPC ..... F02C 9/00; F02C 9/26; F02C 9/08; F02C 7/228; F02C 7/232; F23R 3/28; F23R 3/286; F23D 17/00; F23D 17/002; F23D 17/005; F23D 17/007
See application file for complete search history.

(56) References Cited

U.S. PATENT DOCUMENTS 4,766,721 A * 8/1988 Iizuka et al. ..... 60/39.23
5,259,184 A 11/1993 Borkowicz et al.
5,660,045 A 8/1997 Ito et al.
(Continued)

FOREIGN PATENT DOCUMENTS

EP 0222173 A1 5/1987
EP 1909030 A2 4/2008
(Continued)

OTHER PUBLICATIONS

Search Report and Written Opinion from corresponding PCT Application No. PCT/US2012/068366, dated Jun. 25, 2013.
(Continued)

*Primary Examiner* — Craig Kim
(74) *Attorney, Agent, or Firm* — Pamela A. Kachur

(57) ABSTRACT

A system and method for flame stabilization is provided that forestalls incipient lean blow out by improving flame stabilization. A combustor profile is selected that maintains desired levels of power output while minimizing or eliminating overboard air bleed and minimizing emissions. The selected combustor profile maintains average shaft power in a range of from approximately 50% up to full power while eliminating overboard air bleed in maintaining such power settings. Embodiments allow for a combustor to operate with acceptable emissions at lower flame temperature. Because the combustor can operate at lower bulk flame temperatures during part power operation, the usage of inefficient overboard bleed can be reduced or even eliminated.

6 Claims, 8 Drawing Sheets

(56) References Cited

U.S. PATENT DOCUMENTS

| | | | | |
|---|---|---|---|---|
| 5,836,164 | A * | 11/1998 | Tsukahara et al. | 60/733 |
| 5,862,668 | A | 1/1999 | Richardson | |
| 5,943,866 | A | 8/1999 | Lovett et al. | |
| 6,164,055 | A | 12/2000 | Lovett et al. | |
| 6,192,688 | B1 | 2/2001 | Beebe | |
| 6,311,473 | B1 | 11/2001 | Benjamin et al. | |
| 6,968,693 | B2 | 11/2005 | Colibaba-Evulet et al. | |
| 7,059,135 | B2 | 6/2006 | Held et al. | |
| 7,140,560 | B2 * | 11/2006 | Stotts et al. | 239/461 |
| 7,152,409 | B2 * | 12/2006 | Yee et al. | 60/777 |
| 7,810,333 | B2 | 10/2010 | Kraemer et al. | |
| 8,091,363 | B2 | 1/2012 | Sullivan et al. | |
| 8,099,941 | B2 | 1/2012 | Myers et al. | |
| 8,205,452 | B2 | 6/2012 | Boardman et al. | |
| 2002/0162336 | A1 * | 11/2002 | Weisenstein | F23D 11/36 60/776 |
| 2005/0067506 | A1 | 3/2005 | Stotts | |
| 2008/0016876 | A1 | 1/2008 | Colibaba-Evulet et al. | |
| 2008/0078181 | A1 * | 4/2008 | Mueller et al. | 60/776 |
| 2009/0111063 | A1 | 4/2009 | Boardman et al. | |
| 2009/0241548 | A1 * | 10/2009 | Danis | F23R 3/50 60/747 |
| 2011/0016866 | A1 | 1/2011 | Boardman et al. | |
| 2011/0016871 | A1 | 1/2011 | Kraemer et al. | |
| 2011/0113783 | A1 | 5/2011 | Boardman et al. | |

FOREIGN PATENT DOCUMENTS

| | | | |
|---|---|---|---|
| EP | 1959196 | A2 | 8/2008 |
| EP | 2204617 | | 7/2010 |
| EP | 2213944 | | 8/2010 |
| JP | 0618037 | A | 1/1994 |
| JP | 0814565 | A | 1/1996 |
| JP | 0828874 | A | 2/1996 |
| JP | 11343869 | A | 12/1999 |
| WO | 0212795 | | 2/2002 |
| WO | 03102407 | | 12/2003 |
| WO | 2010147496 | | 12/2010 |

OTHER PUBLICATIONS

Canadian Office Action issued in connection with corresponding CA Application No. 2859770 on Jul. 20, 2015.

Unofficial English Translation of Japanese Office Action issued in connection with corresponding JP Application No. 2014549091 on Aug. 4, 2015.

* cited by examiner

SYSTEM AND METHOD FOR FLAME STABILIZATION

BRIEF DESCRIPTION OF THE DRAWINGS

FIGS. 2-9 illustrate operation in burner modes associated with an embodiment of a system and method for flame stabilization; wherein, FIG. 2 is a cross-sectional view of a premixer disposed within a combustor showing Burner Mode 1 operation at engine start up.

FIG. 3 is an end view illustration of a plurality of premixers disposed within a combustor, relating to the cross-sectional view illustrated in FIG. 2 for Burner Mode 1 operation.

FIG. 4 is a cross-sectional view of a premixer disposed within a combustor showing Burner Mode 2 operation.

FIG. 5 is an end view illustration of a plurality of premixers disposed within a combustor, relating to the cross-sectional view illustrated in FIG. 4 for Burner Mode 2 operation.

FIG. 6 is a cross-sectional view of a premixer disposed within a combustor showing Burner Mode 3 operation.

FIG. 7 is an end view illustration of a plurality of premixers disposed within a combustor, relating to the cross-sectional view illustrated in FIG. 6 for Burner Mode 3 operation.

FIG. 8 is a cross-sectional view of a premixer disposed within a combustor showing Burner Mode 4 operation.

FIG. 9 is an end view illustration of a plurality of premixers disposed within a combustor, relating to the cross-sectional view illustrated in FIG. 8 for Burner Mode 4 operation.

BACKGROUND AND PROBLEM SOLVED

Figure 1:
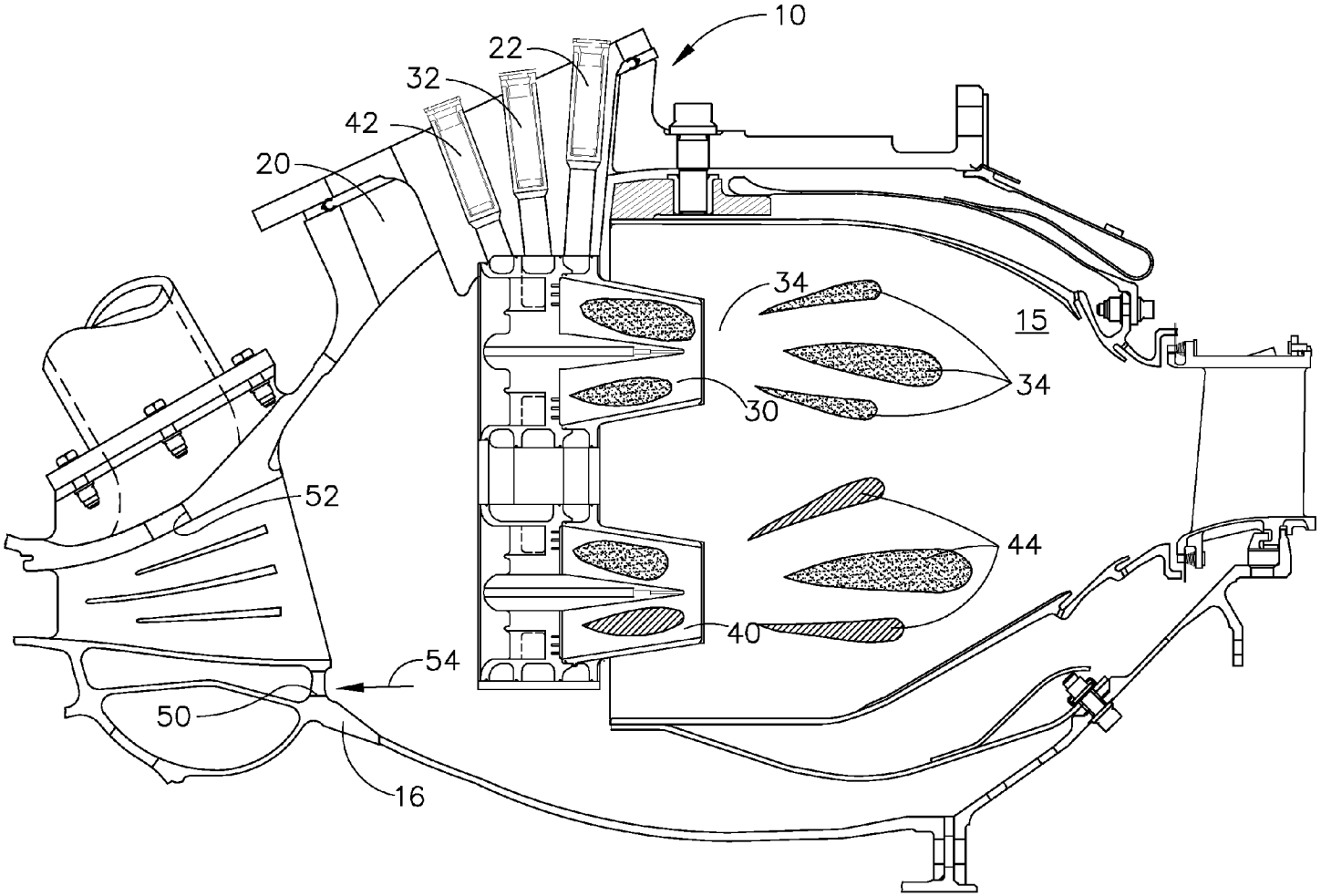
FIG. 1 is a cross-sectional view of a premixer disposed within a combustor showing selected features of an embodiment of a system for flame stabilization.

Gas Turbines utilized in Marine and Industrial applications, especially Mechanical Drive applications, feature combustors as components and are often operated for extended periods of time at partial power. Partial power herein means operation at less than 100% load. As fuel prices increase, improved partial power efficiency is an attribute that is very much desired by operators.

Disposed within a turbine combustor are nozzles that serve to introduce fuel into a stream of air passing through the combustor. Igniters are typically used to cause a resulting air-fuel mixture to burn within the combustor. The burned air-fuel mixture is routed out of the combustor and on through a turbine or turbines to extract power which drives the compression system and provides useful work to an operator.

Dry-Low-Emissions (hereinafter, DLE) combustors are gas turbine engine components relying on lean premixed combustion that operate within bulk flame temperature (hereinafter, Tflame) windows where emissions are within limits. Tflame is the adiabatic flame temperature calculated to result from complete combustion of air and fuel entering fueled combustor cups. At a maximum value for Tflame, the emissions of oxides of Nitrogen (NOx) increases sharply. At a minimum value for Tflame, (hereinafter, Tflame min), the emission of Carbon Monoxide (CO) as an undesirable by-product of combustion increases. In the art, typical operation is to bleed compressor air overboard in order to lower this undesirable emissions by-product. However, such prior art use of overboard bleed air extraction serves to maintain local Tflame in a desired narrow band of temperature range but it also decreases partial power efficiency, thereby increasing fuel operating expenses.

Therefore a problem to be solved is to maximize the partial power efficiency characteristics of DLE gas turbines while minimizing undesirable emissions by-products. Overboard bleed air extraction is typically used at part power operation to maintain acceptable emissions in a DLE system by holding combustor bulk flame temperature in a narrow band. In addition, the prior art has seen a limited amount of staging of premixed rings and cups. As emissions regulations become more stringent, the acceptable window of bulk flame temperatures is growing much more narrow and difficult to achieve. As the Tflame bands narrow, the engine requires increased use of bleed air to remain in the window of acceptable bulk flame temperatures.

Bleed Avoidance Technology (BAT) pertains to a method to improve partial power efficiency in Dry-Low-Emissions (DLE) engines by reducing the amount of bleed air extraction. Embodiments are provided that include BAT to enable diffusion flame operation at low power conditions, premixed flame operation at high power conditions, and a combination of premixed/diffusion flame operation at intermediate power settings thereby providing a means to reduce bleed air requirements to improve performance while simultaneously meeting stringent emissions requirements. Enhanced Lean Blowout (hereinafter, ELBO) refers to the concept that selected features allow for operation at lean air/fuel ratios very close to air/fuel ratios and temperatures seen as at the edge of where existing systems might suffer a loss of flame entirely—"blowout." Variable ELBO refers to ability to vary fuel delivery as desired in such a manner as to optimize lean operation.

Fuel system design requirements in prior art DLE engines have concentrated primarily on full load efficiency and emissions. While a worthwhile goal and one that begins to meet ever-increasing needs in the Art, embodiments utilizing variable ELBO fuel provide enhanced efficiency and reduced emissions at a far wider range of power settings from start-up to full power. Alternatives provide variable ELBO to a majority of the premixes to enhance fuel system functionality and to optimize the reduction of full-power emissions and achieve a partial power turndown in Tflame.

To improve partial power efficiency in legacy DLE applications, the primary approach has been to add circumferential staging modes wherein several cups of the combustor are turned off (i.e not fueled). This approach introduces localized cold zones in the combustor, thereby increasing CO emissions and requiring additional control valves and additional time to map the circumferential modes.

Designs in the Art include the use of two-cup and three-cup premixers. Illustrations provide for an A cup, a B cup, and a C cup for those systems utilizing three cups in the premixer. Other designs in the Art to reduce the need for bleed air extraction include Variable Area Turbine Nozzles (VATN) and bleed re-injection (also known as bypass bleed) back into the power turbine. However, these prior art designs are comparatively expensive, have experienced limited reliability, and are technically complex compared to the present embodiments.

In further detail, prior art DLE engines extract compressor bleed to provide overboard bleed air extraction as a means to maintain combustor flame temperatures above a lower threshold below which CO and UHC emissions increase rapidly. The lower threshold value is referred to as incipient lean blow out.

Solution

In contrast, embodiments are provided that provide a means to forestall incipient lean blow out by improving flame stabilization thereby enabling the combustor to operate with acceptable emissions at lower flame temperature. Embodiments allow the combustor to operate at lower bulk flame temperatures during partial power operation, thereby reducing or even eliminating the usage of inefficient overboard bleed air extraction.

In solving the problem, embodiments are provided that utilize variable ELBO as a feature of the premixer and that inject fuel directly into a combustion chamber. This use of ELBO fuel improves flame stabilization by creating small high temperature diffusion flames that serve as ignition sources for the fuel-air mixture entering the combustor through one or more premixers. In contrast, most of the combustion is lean premixed. The one or more premixers may each have one or more cups with embodiments including those with two cups, A and B (as shown in FIG. 1); and alternatives including those with three cups, A, B and C (not shown). Embodiments and alternatives are provided that increase the range of flame temperatures (Tflame) that allow desired efficient operation at or under acceptable emissions levels. The solution includes the use of variable and independently controlled ELBO fuel thereby allowing optimization of emissions throughout the operating range and the provision of a control system featuring control/staging logic to allow for a flame to be primarily diffusion flame in operation at low power conditions and primarily premixed operation at high power conditions. Operators clearly recognize the cost savings associated with just one percentage point improvement in partial power thermal efficiency. Therefore, these embodiments are of high value to all operators in that measurable results from use of the embodiments provided include an improvement of up to 3 percentage points in partial power thermal efficiency when compared to known art DLE gas turbines operating under similar conditions. While increasing partial power efficiency, embodiments also reduce fuel system cost and complexity. Additional alternatives utilize diffusion flame and thereby reduce combustion acoustics. As such, embodiments serve to improve combustion system durability by reducing transient acoustics. Compared to the Art of staged DLE combustors, embodiments also provide the ability to maintain a more consistent exit profile and pattern factor as well as a lower turbine inlet temperature during partial power operation. This leads to improved hot section durability, sensor accuracy in measuring exhaust temperatures and reliability of the entire system. In general, diffusion fuel flow allows for good operability. Premixed fuel flow allows for good emissions characteristics. Combined diffusion and premixed fuel flow allow for an optimization of both operability and emissions.

DESCRIPTION OF THE EMBODIMENTS

With reference to FIG. 1, in general, a system for flame stabilization 10 comprises a combustor 15 having one or more premixers 20 with one or more premixed cups. The one or more premixed cups are in fluid communication with one or more Variable ELBO Channels formed therein.

Embodiments chosen to be illustrated for purposes of example only, not meant to be limiting, include those utilizing two premixed cups wherein the one or more premixed cups include ELBO features and are an A Premixed Cup 30 and a B Premixed Cup 40. Other embodiments not illustrated utilize three or more premixed cups in each premixer. Alternatives include those wherein the one or more premixers number a total of twenty four (24) premixers.

By way of providing an example of a two-cup premixer embodiment, disposed and formed within each premixer 20 are a Variable ELBO Channel 22, an A Cup Premixed Channel 32 and a B Cup Premixed Channel 42. Variable ELBO Channel 22 serves both the A and B cup, although alternatives are provided (not shown) wherein a separate Variable ELBO Channel is provided to each cup. These channels 22, 32, 42 provide fuel used in creating a flame 34 and 44, respectively, downstream in the combustor 15 from each cup 30, 40 of premixer 20. As desired, fuel may be introduced only through variable ELBO channel 22 thereby making flame 34, 44 a diffusion flame. Fuel may also be introduced through the premix channels 32, 42 thereby making the flame 34, 44 a premix flame. Note that the flames 34, 44 illustrated in FIG. 1 are notional and illustrated in such a fashion as to provide a frame of reference as to where inside the combustor 10 the propagation of such flames 34, 44 begins in general, downstream from cups 30, 40. When all channels 22, 32, 42 are utilized to introduce fuel into the premixer 20 and further into the combustor 15 for burning, then the flame 34, 44 is a combination of diffused and premix flame. By selectably adjusting the flow of fuel as desired, or by stopping fuel flow altogether, in any premixer 20 or any channel 22, 32, 42 there inside, it is possible to achieve enhanced efficiency in operation while also maintaining low emissions.

In the operation of turbines, acoustics is combustion acoustics/dynamics and known to be pressure oscillations often found in DLE engines. Such pressure oscillations are controlled, as desired, in a variety of ways; embodiments presented herein doing so through the use of some diffusion fuel, or ELBO. When operating with diffusion fuel flow—the flow through Variable ELBO Channel 22—additional benefits are selectably provided to the operator in the form of reduction of such pressure oscillations.

For use only as required, a first overboard bleed channel 50 and a second overboard bleed channel 52 are provided in order to facilitate bleed air extraction. Alternatives include those wherein bleed air 54 is extracted from a combustor case 16 (see FIG. 1) or from an interstage port of a compressor (not shown), or at a location between compressors (not shown). Overboard bleed is used in general for DLE systems to insure that the bulk fuel temperature (hereinafter, Tflame) is maintained at an acceptable level. BAT technology, with variable ELBO, allows the Tflame to be reduced while maintaining good emissions and hence delays the onset of bleed air extraction and thereby provides improved partial power efficiency.

As described in detail above and illustrated in FIG. 1, the Variable ELBO features included in each premixer 20 allow that as a function of present power output divided by full load power rating, partial power operation is enhanced.

With reference to FIGS. 2-9, shown are a representational view of system 10 with combustors 15 having fuel burned at various stages of engine operation from low power all the way up to full power to include partial power settings between those two extremes. The selected burner modes are seen in FIGS. 2-9 by a pairing of Figures for each burner mode wherein a cross-sectional view of one premixer 20 is illustrated accompanied by an end view being an annular representation of all the engine's premixers having fuel flowing through a group of choices of: diffusion, premix, or both. Furthermore, any subset of premixers 20 may have any choice of fuel flow taken from the group above. In general, for low power, diffusion fuel flow is utilized. For high power, premixed fuel flow is utilized. For power as desired between these extremes, a selected balance is chosen of both diffusion and premixed fuel flows. Although an example is provided showing four burner modes, it is readily understood the variable nature of the embodiments provided means that there are an unlimited number of burner modes disposed between the mode utilized for engine start up all the way to the mode at full power.

$Tflame_{minimum}$ is improved through the use of diffusion flame stabilization which is achieved by increased use of variable ELBO (enhanced lean blowout) features on combustor 15, with fuel routed selectably, as desired through some or every premixer 20 cup 30, 40 within combustor 15.

Embodiments are provided wherein the overboard bleed that is routed through bleed channels 50, 52 and that is required to enable transition between burner modes is reduced by more than 50%, and is eliminated in a peak engine usage range.

As an example not meant to be limiting and with reference to at least FIGS. 2 through 9, staging as used herein means that an engine is operating in burner modes with further details as below.

Figure 2:
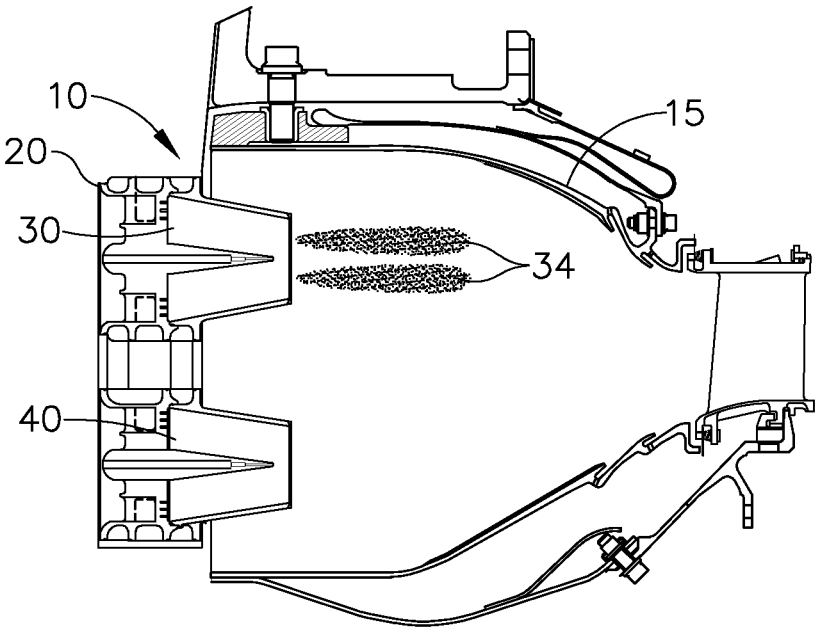
Figure 3:
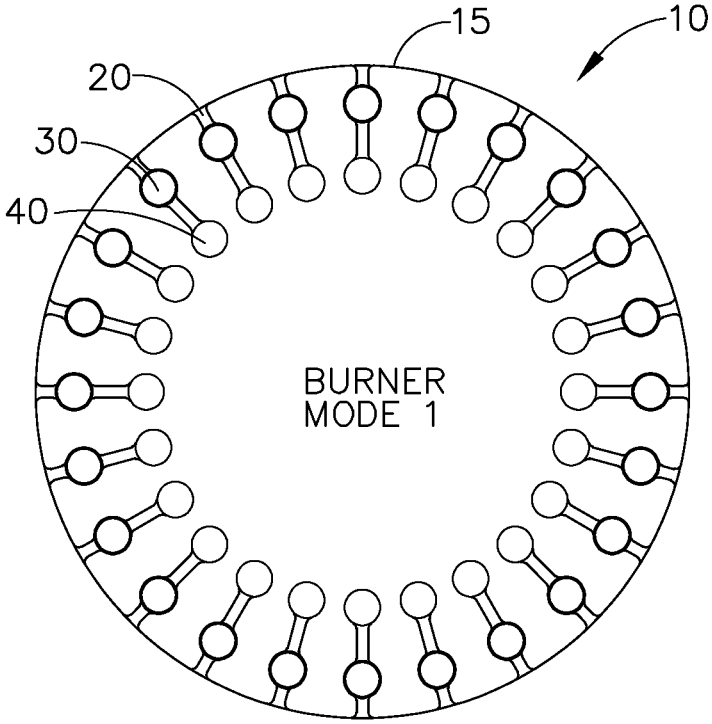

As shown in FIGS. 2 and 3, a gas turbine engine is started and fuel burn occurs within the combustor 15. At this point the engine is in burner node 1, corresponding to the fuel being A ELBO. Although alternatives provide for fuel only through the B cup, in this example, fuel flows only through the Variable ELBO Channel 22 of the A cup 30. No fuel is routed through the B cup 40. The engine begins to operate at low power completely on fuel introduced through the variable ELBO channel 22 with the resulting flame 34 being a diffusion flame 34 originating solely from the A Cup 30. In further detail, with regard to the channels 22, 32, 42 formed and disposed therein, the channels formed in combustor 20 are placed into fluid communication with just the A Cup 30. In addition, in this Burner Mode 1 the only channel so utilized is Channel 22. The B Cups 40 (and C cups, for embodiments utilizing three cups—not shown) have only air passing through them and there is no flame 44 present. This is the condition from start up to approximately 15% power setting.

Figure 4:
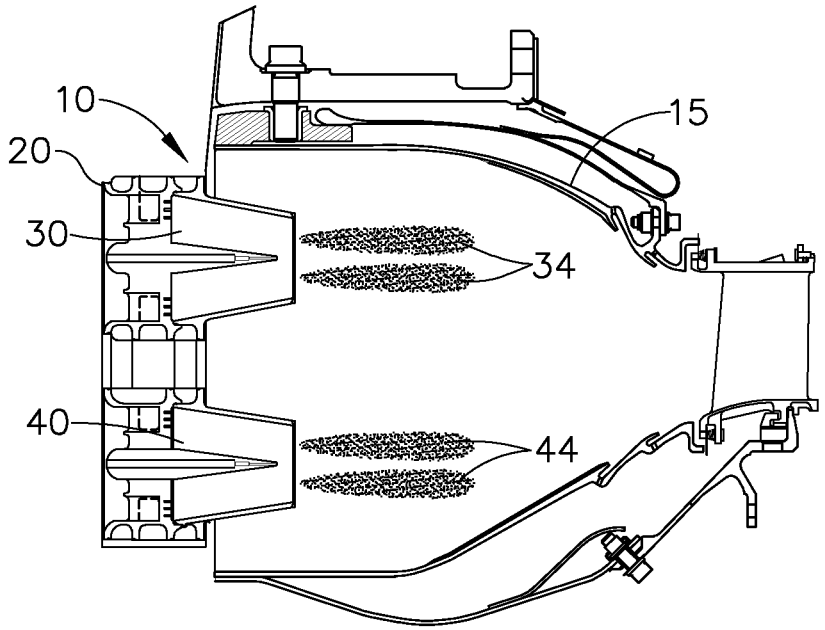
Figure 5:
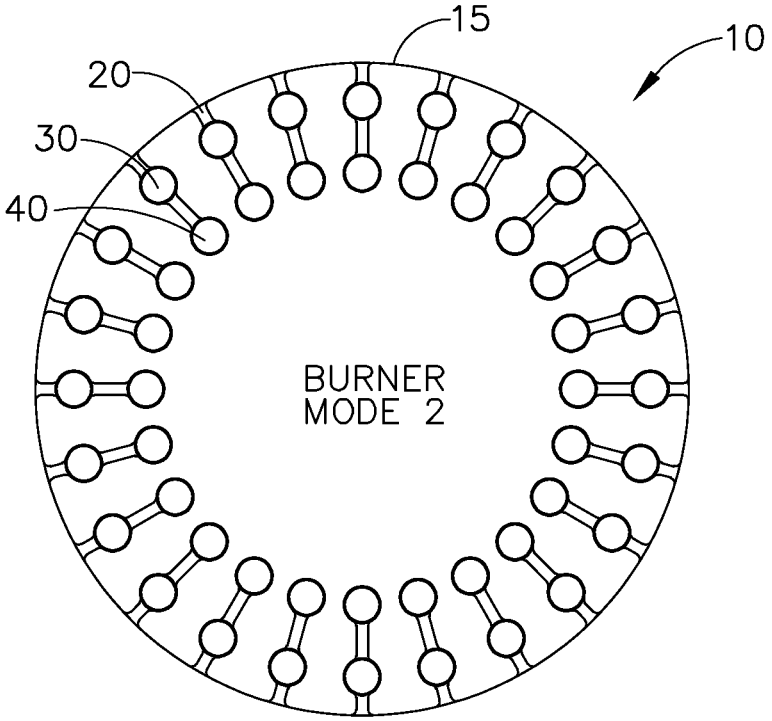

By way of further example and with reference to FIGS. 4 and 5, as demand for power increases from approximately 15% to approximately 50% and at any point within a range of values, the turbine is fed more fuel to provide that power, the combustor 15 transitions from burner mode 1 being solely A ELBO (A Premixed Cup 30 diffusion flow only) operation at low power, to burner mode 2, being a combination of A ELBO along with B ELBO. In further detail as needed, fuel flow is added to premixers as desired wherein some fuel continues to flow through the variable ELBO channel 22 and that fuel is introduced into any number of A Premixed Cups 30 as above, and now also into any number of the B Premixed Cups 40 (and C cups, if present—not shown) in a circumferentially staged manner as needed, thereby providing a staged fashion of operation that allows increases in power output while maximizing the efficiency of operation and minimizing the output of undesired emissions from the turbine. In burner mode 2, the resulting flame 34, 44 is a diffusion flame 34, 44 originating from the A Cup 30 and the B cup 40, respectively.

Figure 6:
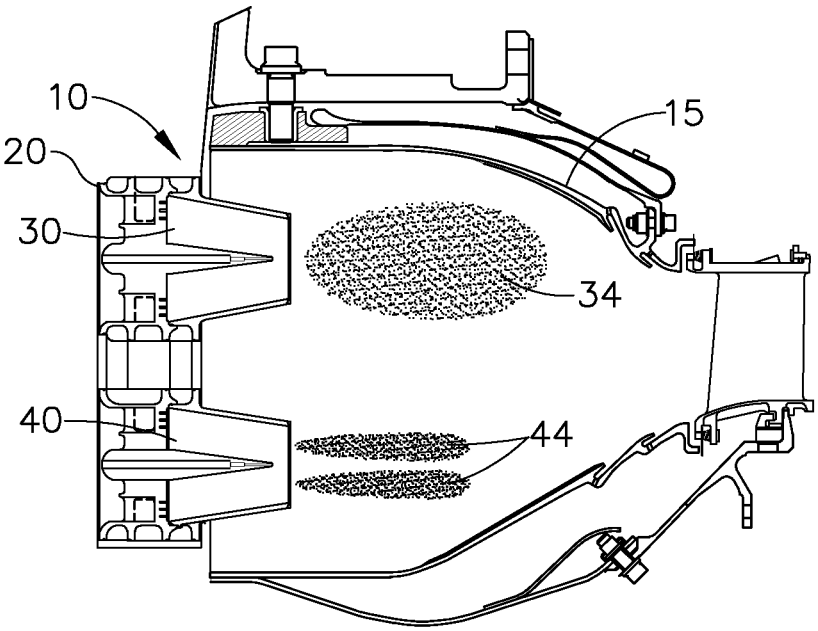
Figure 7:
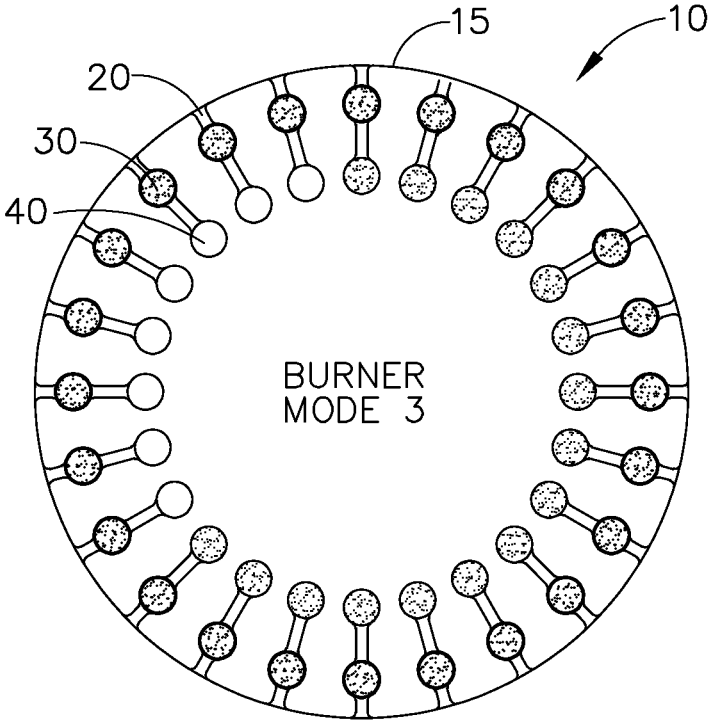

With reference to FIGS. 6 and 7, as demand for power increases from approximately 50% to approximately 75% and at any point within this range of values, and the turbine is fed more fuel to provide that power, the combustor 15 transitions from burner modes 1 and 2 associated with A ELBO (A Cup 30 diffusion flow) and B ELBO (B cup 40 diffusion flow) operation at low power to burner mode 3, a partially lean premixed operation at higher power settings whereby some fuel continues to flow through the variable ELBO channel 22 and fuel is also introduced into some or all of the premixed channels 32, 42 as desired in the A and B Cups (and C cups, if present—not shown), thereby providing a staged fashion of operation that allows increases in power output while maximizing the efficiency of operation and minimizing the output of undesired emissions from the turbine. For example, FIGS. 6 and 7 illustrate an example of A Premixed+A ELBO+B ELBO fuel flow wherein the A cup 30 has transitioned to fuel flow in both the A Cup Premixed Channel 32 and the A cup ELBO Channel 22, with resulting flame 34 being a combination of diffusion and premix flame. Fuel from the B Cup 40 is diffusion fuel flow from the Variable ELBO Channel 22 with resulting flame 44 being a diffusion flame. As desired, at some power settings, some premixers 20 are fed no fuel at all and only air passes through those premixers 20.

Described in a complementary manner to that just above, FIGS. 7 and 8 can also be seen to show an even higher power setting, but still below full power, wherein the fuel continues to flow through all cups. However while Cup A 30 remains in ELBO—the fuel continuing through variable ELBO channel 22 in Cup A with resulting flame 34 in Cup A being a diffusion flame, at this stage, fuel is also introduced through the B Cup premix channel 42 thereby making the flame 44 a premix flame.

To be clear, the burner modes describe above and illustrated as Burner Mode 2 and Burner Mode 3 in FIGS. 4-5 and 6-7, respectively, are not mutually exclusive in staging. In other words, as desired, an operator or a control system may selectably place the system 10 into Burner Mode 2 or Burner Mode 3, as desired and in any order, such that control parameters such as $Tflame_{minimum}$, amount of bleed, power output, etc. are chosen to maximize efficiency and also to minimize emissions.

Figure 8:
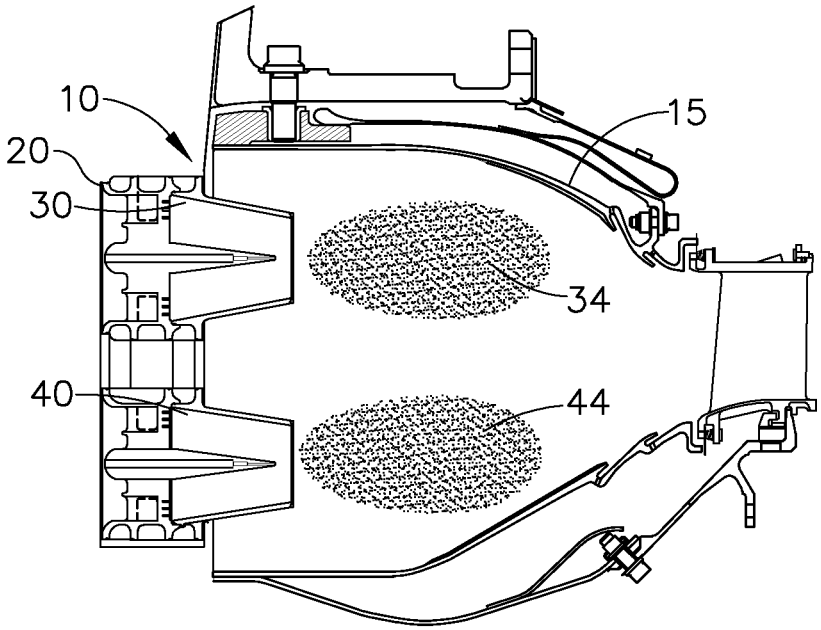
Figure 9:
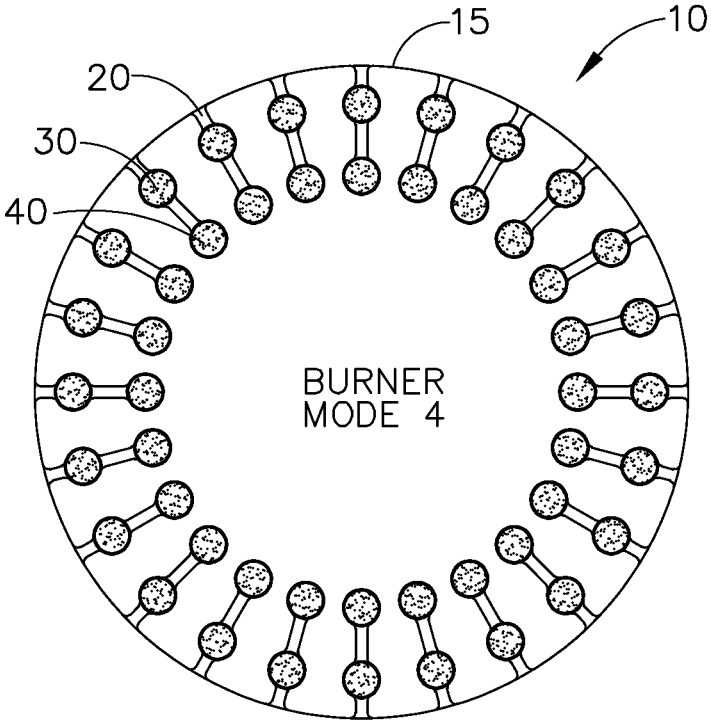

Turning our attention now to operation at full power, FIGS. 8 and 9 show the fuel flow situation at Burner Mode 4 as demand for power increases from approximately 75% to approximately full power and at any point within a range of values, the turbine is fed more fuel to provide that power, the combustor 15 transitions to all cups 30, 40 having all channels activated 22, 32, 42 thereby making flames 34, 44 as primarily premixed flames with or without small amounts of diffusion fuel.

In summary and with regard to the example provided for the purposes of illustration and not meant to be limiting, equating FIGS. 2-9 to burner modes, embodiments and alternatives are provided for staging operation in burner modes as follows:

1. A ELBO (FIGS. 2 and 3)
2. A ELBO+B ELBO (FIGS. 4 and 5)

(Any required circumstances allow for other burner modes to include circumferential burner modes)

3. A ELBO+B ELBO+A PREMIXED (FIGS. 6 and 7) (Any required circumstances allow for other burner modes to include circumferential burner modes)

4. A ELBO+B ELBO+A PREMIXED+B PREMIXED, with ELBO minimized to near zero at full load conditions to optimize NOx emissions (FIGS. 8 and 9)

A Method for Flame Stabilization comprises the steps of:

1) Providing an engine having a controller (not shown) for fuel flow, a combustor 15 having one or more premixers 20, each premixer 20 having one or more cups, for example not meant to be limiting, an A premixed cup 30, and a B premixed cup 40, the one or premixers 20 having formed and disposed within: a variable ELBO channel 22, a Premixed Channel 32, 42 for each cup 30, 40, such channels 22, 32, 42 being placed into fluid communication with the cups 30, 40, wherein, when utilized, the variable ELBO channel 22 provides fuel used in creating a diffusion flame downstream from each cup and the premixed channels 32, 42, when utilized, provide fuel for creating a premixed flame downstream from each cup.
2) Starting the engine whereby fuel at start up is provided by A ELBO (diffusion) fuel in burner mode 1 and maintaining burner mode 1 wherein A ELBO (diffusion) fuel flow results in flame 34 being a diffusion flame through demands of up to approximately 15% partial power.
3) As power demand rises above a level beyond which the A ELBO cup will provide fuel flow allowing operation within desired operating parameters, the controller shifting fuel flow to burner mode 2 wherein A ELBO (diffusion)+B ELBO (diffusion) fuel flow results in flame 34, 44 being a diffusion flame and through demands of between about 15% to about 50% power.
4) As power demand rises above either the A ELBO or the A ELBO+B ELBO threshold, the controller shifting fuel flow to burner mode 3 wherein A ELBO+B ELBO (diffusion)+A PREMIXED fuel flow results in flame 44 remaining a diffusion flame and flame 34 transitioning from a diffusion flame to a premixed flame and through demands of between about 50% to about 75% power.
5) As power demand continues to increase in burner mode 3, embodiments provide that B PREMIXED cups are activated thereby transitioning flame 44 from a diffusion flame to a premixed flame, as desired, in order to control bulk flame temperature.
6) As power demand rises to a full power setting, the controller shifting fuel flow to burner mode 4 wherein A ELBO+B ELBO+A PREMIXED+B PREMIXED fuel flow results in flame 34, 44 being a premixed flame and through demands of between about 75% to 100% or full power.

It can be seen that for embodiments having three cups, burner modes are provided in combinations that allow fuel flow to begin with A ELBO and graduate up to full power wherein A ELBO+B ELBO+C ELBO+A PREMIXED+B PREMIXED+C PREMIXED cups are activated for a burner mode at full power settings. Similarly, intermediate three-cup burner modes are provided corresponding to the burner modes described above.

In addition, the controller analyzes factors to include power demand, control temperature expressed as Tflame and average thermal efficiency and adjusts staging through any of the burner modes, including circumferentially staging, in any order whatsoever, following burner modes in order, altering utilization of premixers in selected burner modes, or skipping any burner modes as required, in order to maintain desired levels of power output while minimizing or eliminating overboard air bleed and minimizing emissions.

With these principles and details discussed as to the system and method 10 and associated fuel flow and burner modes, we may now turn our attention to graphical representations of characteristics.

Figure 10:
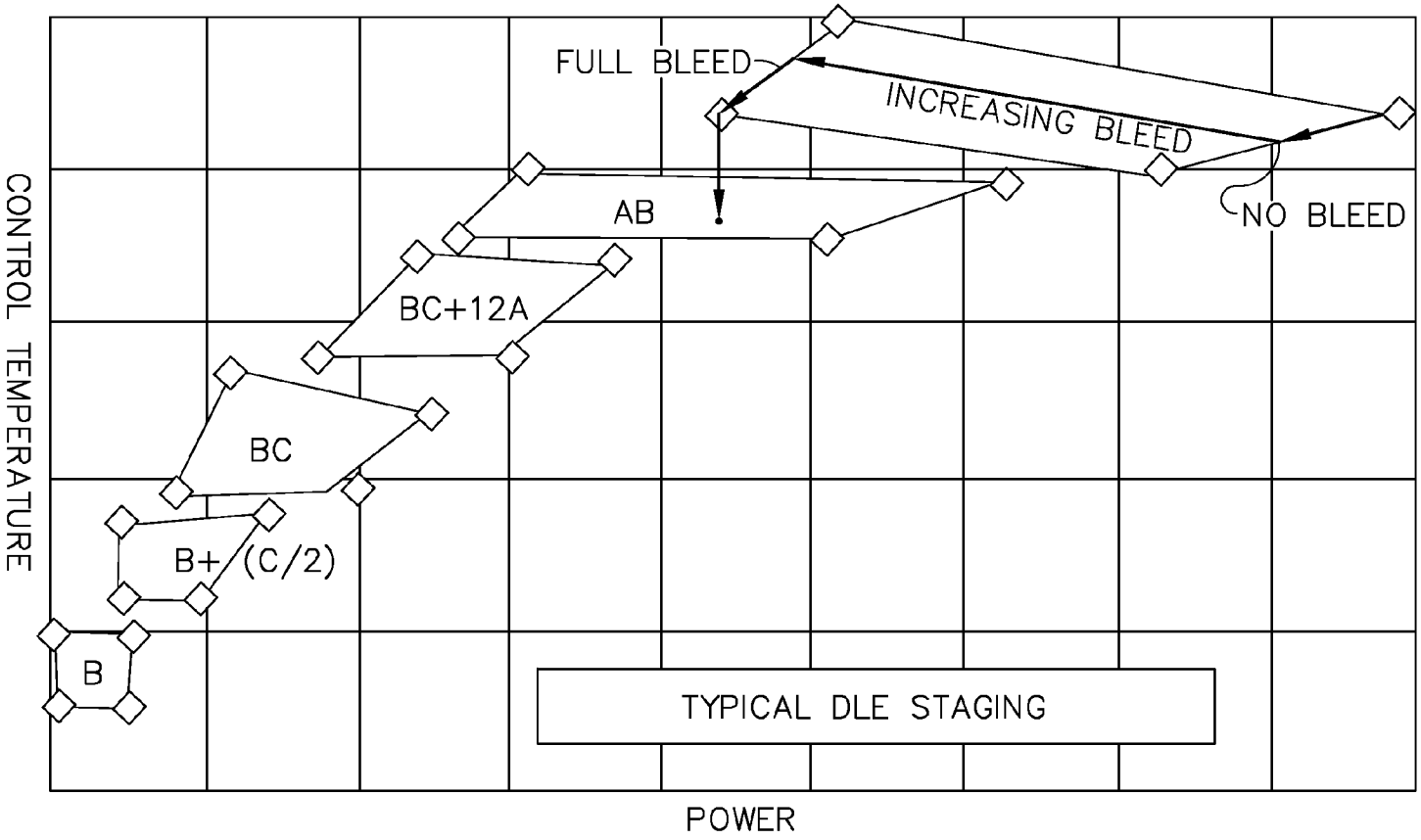
FIG. 10 (PRIOR ART)
FIG. 10 shows Prior Art typical DLE Staging as a function of power and control temperature.

FIG. 10 is provided solely as a means to make reference to Prior Art systems for DLE and typical DLE staging associated with such systems. Shown a non-dimensional representation of power along the bottom of FIG. 3 from lower on the left running horizontally to higher on the right. Control Temperature measured at the turbine inlet is shown from lower (where it meets power) to higher along the left vertical margin of the Figure. The Prior Art example refers to three-cup operation and it is in the upper left hand region of each quadrilateral that uses maximum bleed air. This situation would be the same for prior art two-cup systems. Additionally, in the prior art, extensive use of bleed air is required which increases the turbine inlet temperature at power, thereby maintaining emissions but sacrificing engine efficiency.

Figure 11:
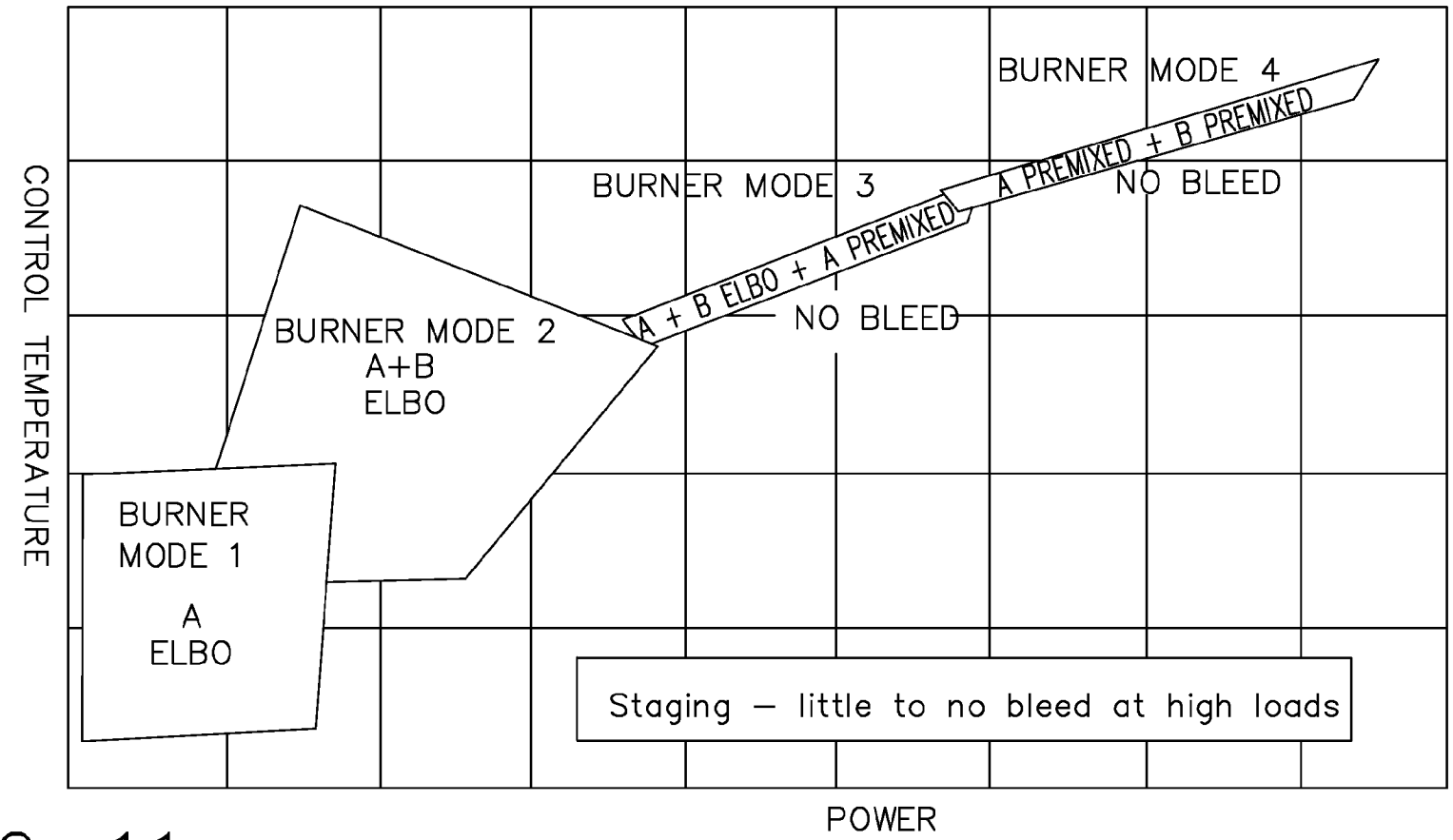
FIG. 11 shows staging associated with an embodiment of a system and method for flame stabilization as a function of power and control temperature.
Figure 12:
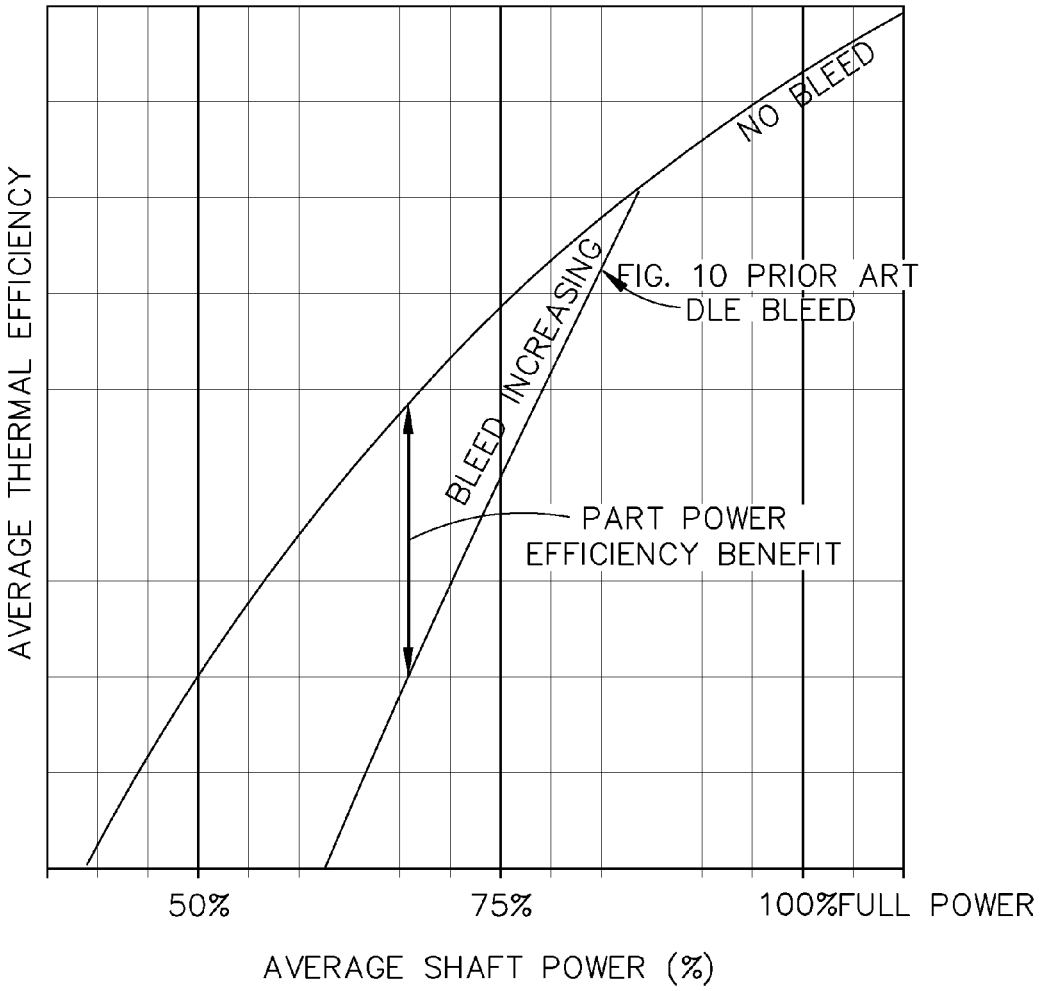
FIG. 12 shows the prior art systems of FIG. 10 in comparison with an embodiment of a system and method for flame stabilization as a function of average shaft power and average thermal efficiency.

In contrast, FIG. 11 is set up to display the data in a similar fashion, but now for embodiments of systems and methods 10. As shown in FIG. 12, by comparison of FIG. 11 with FIG. 10, it is clear that embodiments provide quite a different manner of controlling the amount of and reducing or eliminating altogether any bleed required at high loads.

With reference in particular to FIG. 11, as power is reduced from full—at the upper right hand of the Figure, you see that embodiments feature selectably choosing burner modes as discussed above such that acceptable Control Temperature is maintained without the need to utilize bleed channels and associated overboard bleed extraction. This feature accounts for marked reductions in emissions over the systems of FIG. 10. It bears mention that NOx emission levels are achieved by low amounts of variable ELBO near full load. Embodiments are provided that use Variable ELBO to improve flame temperature turndown, or lean blowout, (hereinafter, LBO) so as to minimize the use of bleed extraction in the engine and thereby improve partial-power efficiency.

FIG. 12 provides a graphical representation of average shift power expressed as a percentage of power versus average thermal efficiency. Embodiments of a system for flame stabilization include those wherein no bleed is used at higher loads and they follow the curve as indicated. In contrast, systems in the Prior Art (refer also to FIG. 10) follow the graphical plot depicted deviating generally downward from the no bleed line of system 10 embodiments. In contrast to embodiments and alternative presented herein, such prior art systems must increase bleed amounts and accept higher levels of emissions and reduced efficiency (as compared to embodiments and alternatives presented herein) as the power is reduced—see right hand curve departing from main curve at approximately 0.8 of max rated power on the graph of FIG. 12.

We claim:

1. A method for flame stabilization comprises the steps of:

a. providing an engine having a controller for fuel flow, a combustor having one or more premixers, each premixer having a plurality of cups, the one or premixers having formed and disposed within: a variable Enhanced Lean Blowout (ELBO) channel, a premixed channel for each of the plurality of cups, such channels being placed into fluid communication with the plurality of cups wherein, when utilized, the variable ELBO channel provides fuel used in creating a diffusion flame downstream from each of the plurality of cups and the premixed channels, when utilized, provide fuel for creating a premixed flame downstream from each of the plurality of cups;

b. starting the engine whereby fuel at start up is provided by fuel in first ELBO channel (A ELBO) of a first cup (A premixed cup), in burner mode 1, and maintaining burner mode 1, resulting in a flame being a diffusion flame through a first threshold, wherein the first threshold demands up to approximately 15% power;

c. the controller shifting fuel flow to burner mode 2 when power demand exceeds the first threshold, wherein burner mode 2 consists of A ELBO and adds fuel from a second ELBO channel (B ELBO) in a second cup (B premixed cup), and resulting in diffusion flames and maintaining mode 2 through a second threshold, wherein the second threshold demands up to approximately 50% power;

d. the controller shifting fuel flow to burner mode 3 when power demand exceeds the second threshold, wherein burner mode 3 consists of A ELBO+B ELBO and the addition of fuel from a premixed channel of A cup (A PREMIXED), wherein the combined fuel flow results in another flame resulting from fuel flowing in the B premixed cup (B PREMIXED) remaining a diffusion flame and the second flame resulting from the fuel flowing in the A premixed cup transitioning from a diffusion flame to a premixed flame and maintaining mode 3 through a third threshold, wherein the third threshold demands up to approximately 75% power;

e. as power demand continues to increase in burner mode 3, a premixed channel from B premixed cup (B PREMIXED) is activated thereby transitioning the flame resulting from the fuel flowing in the B premixed cup transitioning from a diffusion flame to a premixed flame in order to control bulk flame temperature; and f. as power demand rises above the third threshold to a full power setting, the controller shifts fuel flow to burner mode 4, wherein A ELBO+B ELBO+A PREMIXED+B PREMIXED fuel flow results in flames being premixed flames.

2. The method of claim 1 wherein the one or more premixers have a fuel flow selected from the group: diffusion, premix, both, no fuel flow; and, any subset of premixers may have any choice of fuel flow taken from the group.

3. The method of claim 2 wherein the controller analyzes factors selected from the group: power demand, control temperature as Tflame, average thermal efficiency and adjusts staging through any of the burner modes, including circumferentially staging, in any order whatsoever, following burner modes in order, altering utilization of premixers in selected burner modes, or skipping any burner modes as required, in order to maintain desired levels of power output while minimizing or eliminating overboard air bleed and minimizing emissions.

4. The method of claim 3 wherein the desired levels of power output are maintained while minimizing or eliminating overboard air bleed and minimizing emissions.

5. The system of claim 4 wherein the average shaft power is maintained in a range of from approximately 50% up to full power while eliminating overboard air bleed in maintaining such power settings.

6. The method of claim 4 wherein the plurality of cups includes a third cup (C Premixed Cup) and C premixed cup having a premixed channel (C PREMIXED).

* * * * *